United States Patent [19]

Oyama et al.

[11] Patent Number: 5,023,416

[45] Date of Patent: Jun. 11, 1991

[54] CIRCUIT BREAKER

[75] Inventors: Jun Oyama; Naoshi Uchida; Makoto Unuma; Tatsunori Takahashi; Hisaji Shinohara; Kiyoshi Kandatsu, all of Kanagawa, Japan

[73] Assignee: Fuji Electric Co., Ltd., Kanagawa, Japan

[21] Appl. No.: 456,791

[22] Filed: Dec. 29, 1989

[30] Foreign Application Priority Data

Oct. 3, 1989 [JP] Japan ..... 1-258584
Oct. 14, 1989 [JP] Japan ..... 1-266588
Dec. 14, 1989 [JP] Japan ..... 1-324289

[51] Int. Cl.[5] ..... H01H 1/22

[52] U.S. Cl. ..... 200/244; 200/245; 200/144 R; 335/16

[58] Field of Search ..... 200/244, 245, 247, 437, 200/254, 255, 256, 554, 401, 144 R; 335/16, 147, 195; 439/839, 822, 819

[56] References Cited

U.S. PATENT DOCUMENTS 2,553,892 5/1951 Brugger ..... 200/554
3,287,533 11/1966 Rys ..... 200/554
4,482,877 11/1984 Castonguay et al. ..... 200/244 X
4,554,427 11/1985 Flick et al. ..... 200/245
4,645,890 2/1987 Paton et al. ..... 200/244 X
4,645,891 2/1987 Changle ..... 200/244 X
4,782,583 11/1988 Castongway et al. ..... 335/16
4,841,266 6/1989 Wulff ..... 335/16
4,845,459 7/1989 Manthe et al. ..... 335/195
4,864,261 9/1989 Kandatsu ..... 335/16
4,931,603 6/1990 Castonguay et al. ..... 200/144 R

FOREIGN PATENT DOCUMENTS 862468 12/1970 France ..... 200/245
385964 3/1965 Switzerland ..... 200/245

*Primary Examiner*—Henry J. Recla
*Assistant Examiner*—Glenn T. Barrett
*Attorney, Agent, or Firm*—Finnegan, Henderson, Farabow, Garrett, and Dunner

[57] ABSTRACT

A circuit breaker in which a movable contactor is held by a holder of electrically insulating material which is rotatably supported through a switching shaft on a casing. The movable contactor is driven by a switching mechanism to be swung about the switching shaft together with the holder to perform a switching operation. The movable contactor is slidably electrically connected to a connecting conductor secured to the casing.

17 Claims, 8 Drawing Sheets

CIRCUIT BREAKER

BACKGROUND OF THE INVENTION

This invention relates to relatively small circuit breakers such as wiring circuit breakers and earth leakage breakers, and more particularly, to the structure of such a circuit breaker which electrically connects a movable contactor, which is operated by a drive unit, to a connecting conductor secured to a casing.

FIGS. 13 and 14 shows one example of a conventional three-pole type circuit breaker (wiring circuit breaker). More specifically, FIGS. 13 and 14 are sectional diagrams taken along its central pole, showing a closed state and a open state thereof, respectively.

In FIG. 13, reference numeral 1 designates a resin-molded casing; 2, a cover; 3, a stationary contactor which is integral with a power-source-side terminal 3*a*, the contactor 3 being secured to the casing 1 with screws (not shown); 4, a stationary contact provided on the stationary contactor 2; 5, a movable contactor swingably mounted through a shaft 7 on a resin-molded holder 6; 8, a movable contact provided on the movable contactor 5 in such a manner as to confront with the stationary contact 4; 9, an overcurrent tripping device comprising a bimetallic member 9*a*, a L-shaped stationary conductor 9*b* welded to the bimetallic member 9*a*, a stationary magnet 9*c* surrounding the bimetallic member 9*a*, and an armature 9*d* confronted with the stationary magnet 9*c* in such a manner that it is swingable; 10, a connecting conductor piled on the stationary conductor 9*b* and secured to the casing 1 with a screw 11; 12, a flexible conductor both ends of which are connected to the movable contactor 5 and the connecting conductor 10 by blazing; 13, a load-side terminal secured to the casing 1 with a screw 14; and 15, a flexible conductor which is connected between the bimetallic member 9*a* and the terminal 13.

Further in FIG. 13, reference numeral 16 designates a switching mechanism for swinging the movable contactor 5 together with the holder 6. The switching mechanism 16 is normally latched by a tripping mechanism 18 including a cross bar 17 extended over the poles. A handle lever 19 is rockably supported in such a manner that it is swingable right and left. More specifically, the handle lever 19 is coupled through a switching spring 20 to the switching mechanism 16, and has a handle 21 at the top. A contact spring 22 is connected between the holder 6 and the movable contactor 5 so as to urge the movable contactor 5 towards the stationary contactor 3.

The movable contactors of the right and left poles (not shown) are provided on the right and left of the movable contactor 5. These movable contactors are also rotatably mounted through shafts on holders similar to that 6 shown in FIG. 13. Those holders of the three poles are coupled to one another through a switching shaft, which is rotatably fitted in bearing grooves formed in inter-phase partition walls of the casing 1. Further in FIG. 13, reference numeral 23 designates an arc extinguishing chamber provided over the range of movement of the movable contact 8.

In the circuit breaker thus constructed, current is allowed to flow from the stationary contactor 3 through the stationary contact 4, the movable contact 8, the movable contactor 5, the flexible conductor 12, the connecting conductor 10, the stationary conductor 9*b*, the bimetallic member 9*a* and the flexible conductor 15 to the terminal 13. If, in this case, overcurrent about ten times as large as the rated current flows in the circuit breaker, then the bimetallic member 9*a* is curved to the left in FIG. 13, thus pushing the cross bar 17. As a result, the switching mechanism 16 is released from the tripping mechanism, so that the movable contactor 5 is swung together with the holder 6 by the elastic force of the switching spring 20, thus quickly leaving from the stationary contactor 3. In this operation, arcs are formed between the stationary contact 4 and the movable contact 8, however, they are drawn into the arc extinguishing chamber 13 by the electromagnetic force induced.

In the case where large current such as short-circuit current flows in the circuit breaker, the stationary magnet 9*c* will attract the armature 9*d*. Therefore, in this case, the cross bar 17 is struck before the bimetallic member 9*b* is curved, thus causing the movable contactor to disengage from the stationary contactor 3 instantaneously. When the circuit breaker is opened by turning the operating handle 21 to the right as shown in FIG. 14, with the switching mechanism 16 latched the movable contactor 5 is raised by the elastic force of the switching spring 20, thus leaving from the stationary contactor as shown.

In the conventional circuit breaker described above, the movable contactor 5 swung by the switching mechanism 16 is electrically connected through the flexible conductor 12 to the connecting conductor 10 secured to the casing 1. The flexible conductor 12 is, in general, formed by weaving a number of bundles of thin copper wires. However, the use of the flexible conductor in the circuit breaker suffers from the following difficulties:

(1) As the movable contactor 5 is swung, the flexible conductor 12 is also swung. To increase the movement of the flexible conductor 12 would increase the swing of the flexible conductor 12, so that the flexible conductor 12 might be broken by an accumulation of metal fatigue.

(2) In order to prevent the breakage of the flexible wire 12, the latter should not be greatly deformed when swung. For this purpose, it is essential to provide a space large enough to accommodate it. However, in this case, the rated current is necessarily increased, and the flexible conductor 12 must be increased in diameter accordingly. As a result, the casing 1 must be increased in size; that is, it is difficult to miniaturize the circuit breaker.

(3) The movable contactor 5 is resisted by the flexible conductor 12 when swung for a switching operation. The resistance given by the flexible conductor depends on the condition of connection of the flexible conductor with the mating parts and on the frequency of switching of the circuit breaker, thus affecting the contact pressure of the contacts 4 and 8 and the speed of movement of the movable contactor 5.

SUMMARY OF THE INVENTION

In view of the foregoing, it is an object of this invention to provide a circuit breaker in which the movable contactor is electrically connected to the stationary-side connecting conductor without use of the flexible conductor, whereby the above-described difficulties accompanying a conventional circuit breaker are eliminated.

Another object of the invention is to provide a circuit breaker in which the above-described electrical connection is obtained more positively.

A further object of the invention is to provide a circuit breaker in which the movable contact can be readily mounted on the holder.

A still further object of the invention is to provide a circuit breaker in which the electrically connected parts are lengthened in service life.

The foregoing objects of the invention have been achieved by the provision of a circuit breaker in which a movable contactor is held by a holder of electrically insulating material which is rotatably supported through a switching shaft on a casing, and the movable contactor is driven by a switching mechanism to be swung about the switching shaft together with the holder to perform a switching operation; in which, according to the invention, the movable contactor is slidably electrically connected to a connecting conductor secured to the casing.

In order to allow the movable contactor to slidably electrically connect to the connecting conductor, according to the invention, the connecting conductor has a pair of arms at the connecting end through which the connecting conductor is electrically connected to the movable contactor, in such a manner that the movable contactor is located between the arms, and a pair of springs are disposed on both sides of the arms so as to push the arms against the side walls of the movable contactor.

In this connection, the arms of the connecting conductor have portions near the contact surfaces of the arms with the movable contactor in such a manner that the portions are confronted with each other and the distance therebetween is smaller than that between the contact surfaces, so that the electromagnetic force inducted therein is utilized more effectively to increase the contact pressure therebetween.

The movable contactor is mounted to a mounting member with engaging pieces formed by cutting a thin plate, and the mounting member is then press-fitted in a holder with a recess which has engaging steps in correspondence to the engaging pieces. This will facilitate the assembling of the circuit breaker.

The contact surfaces are heated by the frictional heat generated when slid or by the Joule heat produced when current passes through them. If the contact surfaces are of ordinary electrical conductive material such as copper or copper alloy, then they will be readily oxidized by the heating, as a result of which the contact resistance is increased; that is, the current capacity is decreased. In order to prevent the oxidation of the contact surfaces thereby to maintain the current capacity of the latter unchanged, the following method is generally employed: the slide contact surfaces are plated with silver (Ag).

However, the inventors have found through experiments that, when a no-load switching operation (in which the contact surfaces are slid with no current) is repeatedly carried out, the silver layers on the contact surfaces are worn to expose the ground metal, copper, and when large current is interrupted (with current flowing through the contact surfaces), the silver layers are molten to expose the copper.

In order to eliminate this difficulty, in the invention the slide contact surfaces of at least one of the movable contactor and connecting conductor are plated with a silver and carbon compound material.

In the circuit breaker of the invention, the movable contactor and the connecting conductor are in slide contact with each other so that they are electrically connected to each other. Therefore, the difficulty caused by the breaking of the flexible conductor is eliminated, and it is unnecessary to provide a space for the flexible conductor in the casing. In this case, the brake torque applied through the connecting conductor to the movable contactor when the latter performs a switching operation (i.e., when the movable contactor swings about the coupling shaft of the holders) is the product of the frictional force at the contact surfaces and the average radius of rotation of small contact areas. Therefore, the effect of the brake torque is less on the contact pressure and switching speed of the movable contact which is provided at the end of the movable contactor which is much longer than the average radius of rotation. In addition, the above-described frictional force is maintained substantially unchanged until the slide contact surfaces are galled or welded.

In the circuit breaker of the invention, the connecting conductor has a pair of arms formed at the connecting end through which the connecting conductor is electrically connected to the movable contactor in such a manner that the arms are confronted with each other and the movable contactor is held between the arms. In this case, the contact area is twice as large as that in the case where only one side of the movable contactor is in contact with the connecting conductor. Furthermore, the electromagnetic attractive force induced between the currents which flow in the two arms in the same direction acts to push the arms against the movable contactor more effectively. If, in this case, the arms of the connecting conductor are allowed to have inwardly curved portions in the vicinity of the contact surfaces of the arms with the movable contactor in such a manner that the distance between the inwardly curved portion is smaller than that between the contact surfaces, then the above-described electromagnetic attractive force is more effectively utilized to increase the contact pressure. The contact pressure can be maintained more positively by providing compression springs on both sides of the arms to push the latter against the movable contactor.

The movable contactor is held by the holder as follows. First the movable contactor is secured to a mounting member with engaging pieces which are formed by cutting a thin plate, and then the mounting member is press-fitted in a holder with a recess which has engaging steps in correspondence to the engaging pieces. In this case, the movable contactor can be combined with the holder in one action, which facilitates the assembling of the circuit breaker.

The inventors have considered about the exposure of the ground metal, copper, as follows. The reason why the silver layer is worn to expose the ground metal, copper, when the no-load switching operation is repeatedly carried out with the movable contactor in slide contact with the connecting conductor is that the silver layers formed on the movable contactor and the connecting conductor are galled. In addition, the reason why the copper layer is exposed when large current is interrupted is that the silver layers on the movable contactor and the connecting conductor are welded to each other. When, in the latter case, the welded part or parts are broken while being slid, the contact surfaces become rough and accordingly unsatisfactory in electrical contact, as a result of which they are further heated by the current to a higher temperature, thus becoming more liable to be molten or welded.

This difficulty can be eliminated by forming films on the slide contact surfaces by using a compound material which is prepared by dispersing carbon (C) particles in a silver matrix As is well known in the art, carbon is excellent in lubricity, but is not welded to with silver at all. Hence, the silver-carbon compound material can prevent the occurrence of galling when the no-load switching operation is carried out repeatedly. Furthermore, at the interruption of large current, the layers formed on the contact surfaces with the compound material may be molten, but they will not be welded to each other. Thus, in both cases, the slide contact surfaces are kept smooth, and have a sufficient current capacity.

BRIEF DESCRIPTION OF THE DRAWINGS

The present invention will be apparent from the following detailed description taken in conjunction with the accompanying drawings in which.

DETAILED DESCRIPTION OF THE PREFERRED EMBODIMENTS

Figure 1:
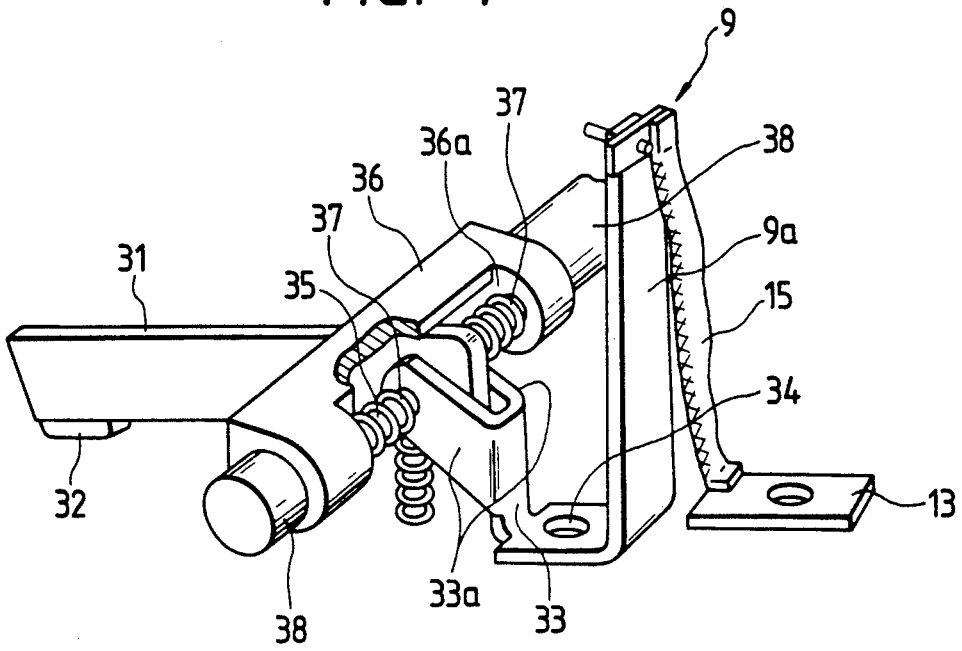
FIG. 1 is a perspective view showing a movable contactor and its relevant components in a first embodiment of this invention.

Preferred embodiments of this invention will be described with reference to FIGS. 1 through 11. In these figures, those components which have been described with reference to FIG. 13 showing the conventional circuit breaker are designated by the same reference numerals or characters.

FIG. 1 is a diagram for a description of the principle of the invention. More specifically, FIG. 1 is a perspective view showing the movable contactor of the central pole in a first embodiment of the invention. The movable contactor 31 is formed by blanking a copper plate, and has a movable contact 32 welded to its one end by brazing. A connecting conductor 33 is integral with the bimetallic member 9*a* and has a through-hole 34, into which a screw (not shown) is inserted to secure the connecting conductor 33 to the casing 1. In this case, it is unnecessary to provide the conductor 9*b* (shown in FIG. 13) for fixing the bimetallic member 9*a*. The connecting conductor 33 has a pair of arms 33*a* on both sides which confront each other. The arms 33*a* elastically hold the end portion of the movable contactor 31. In other words, the arms are in sliding contact with the movable contactor 31. The movable contactor 31 and the arms 33*a* have through-holes (not shown) in alignment with one another into which a shaft 35 is inserted as shown in FIG. 1.

A recess 36*a* for receiving the movable contactor 31 is formed in a resin-molded holder 36. Both ends of the shaft 35 are fitted in the side walls of the recess 36*a*. More specifically, coil springs, or compression springs, 37 are mounted on the shaft 35 on both sides of the arms 33*a* so that the inner walls of the arms 33*a* are pushed against the side walls of the movable contactor 31. The holder 36 is coupled through switching shafts 38 integral with it to the holders of the right and left poles. The holder is rotatably mounted on the casing 1 through the switching shafts 38. When driven by the switching mechanism 16, the movable contactor 31 is swung about the switching shaft 38, and at the same time the other right and left movable contactors (not shown), which are supported by the holders (not shown), are also swung about the switching shaft 38.

Figure 2:
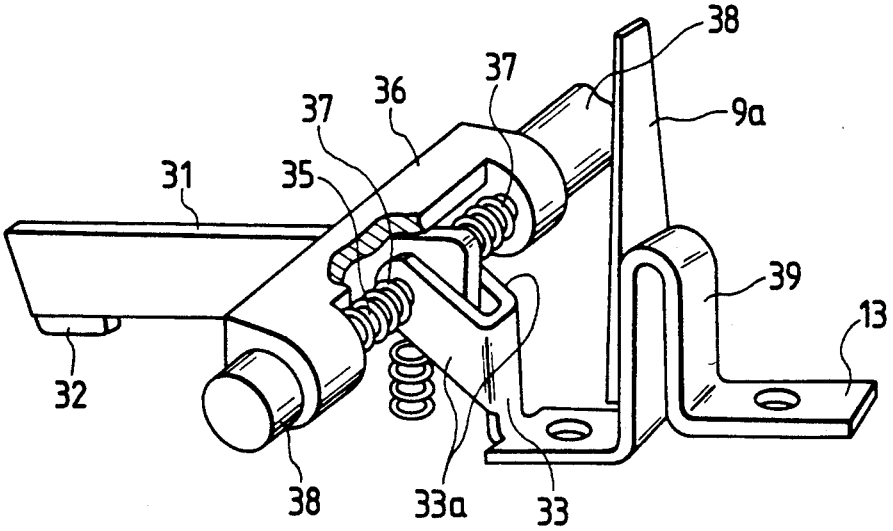
FIG. 2 is a perspective view showing a movable contactor and its relevant components in a second embodiment of the invention.
Figure 13:
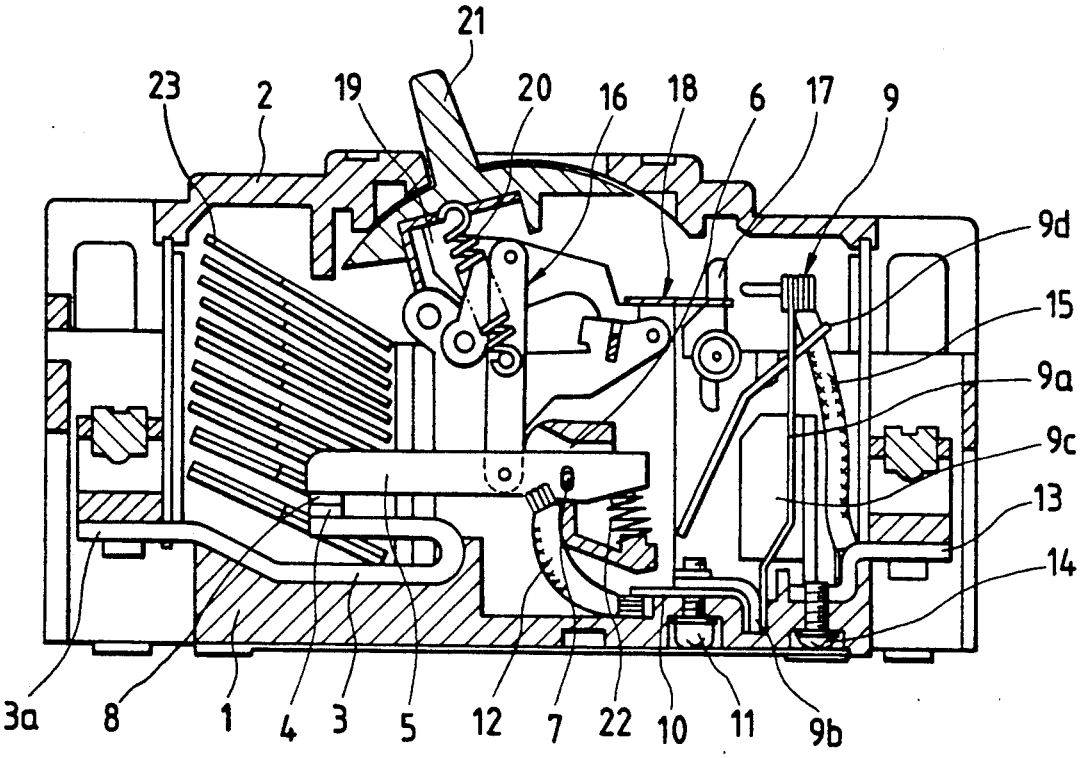
FIG. 13 PRIOR ART
FIG. 13 is a vertical sectional view showing the central pole of a conventional circuit breaker in which central pole is closed.
Figure 14:
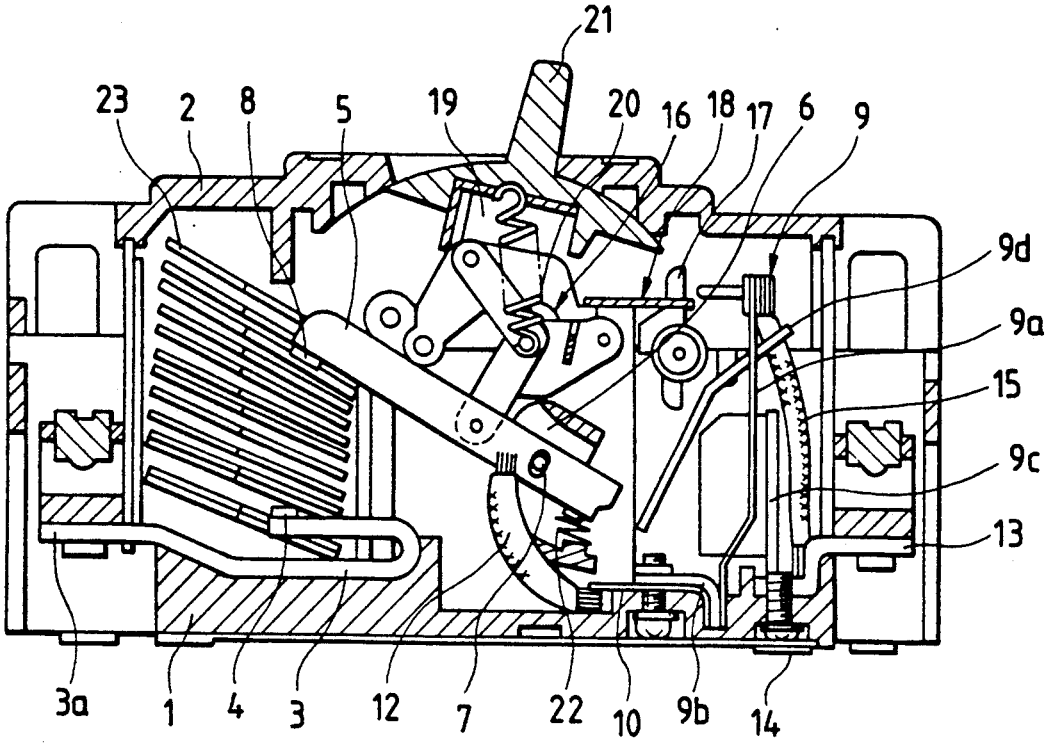
FIG. 14 PRIOR ART
FIG. 14 is a vertical sectional view showing the central pole which is open.

The overcurrent tripping devices 9 in the conventional circuit breaker shown in FIG. 13 and the circuit breaker of the invention shown in FIG. 1 are of the directly heated type wherein current is applied to the bimetallic member 9*a* itself. However, there is available an overcurrent tripping device of indirectly heated type in which current is applied to a heater conductor so that the heat generated thereby is transmitted to the bimetallic member coupled to it. FIG. 2 shows a circuit breaker using such an overcurrent tripping device, a second embodiment of the invention. The second embodiment is the same as the first embodiment shown in FIG. 1, except that the connecting conductor 33 is integral with a heater conductor 39.

Figure 3:
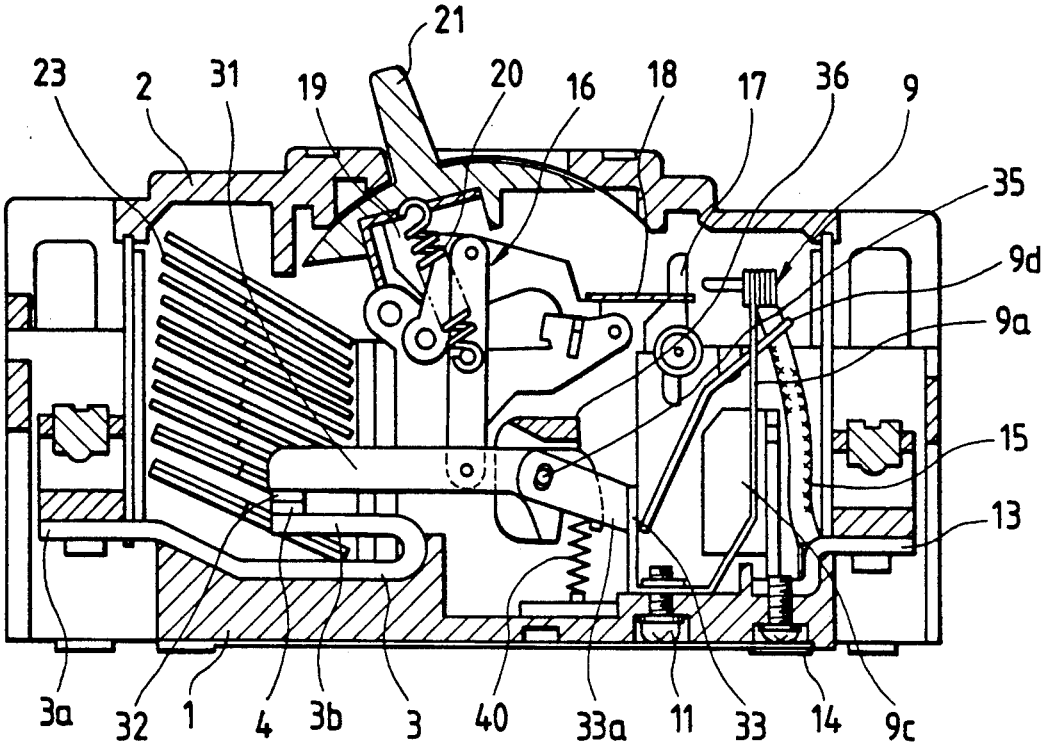
FIG. 3 is a vertical sectional view showing the central pole of a circuit breaker equipped with the movable contactor and its relevant components shown in FIG. 1, which central pole is closed.
Figure 4:
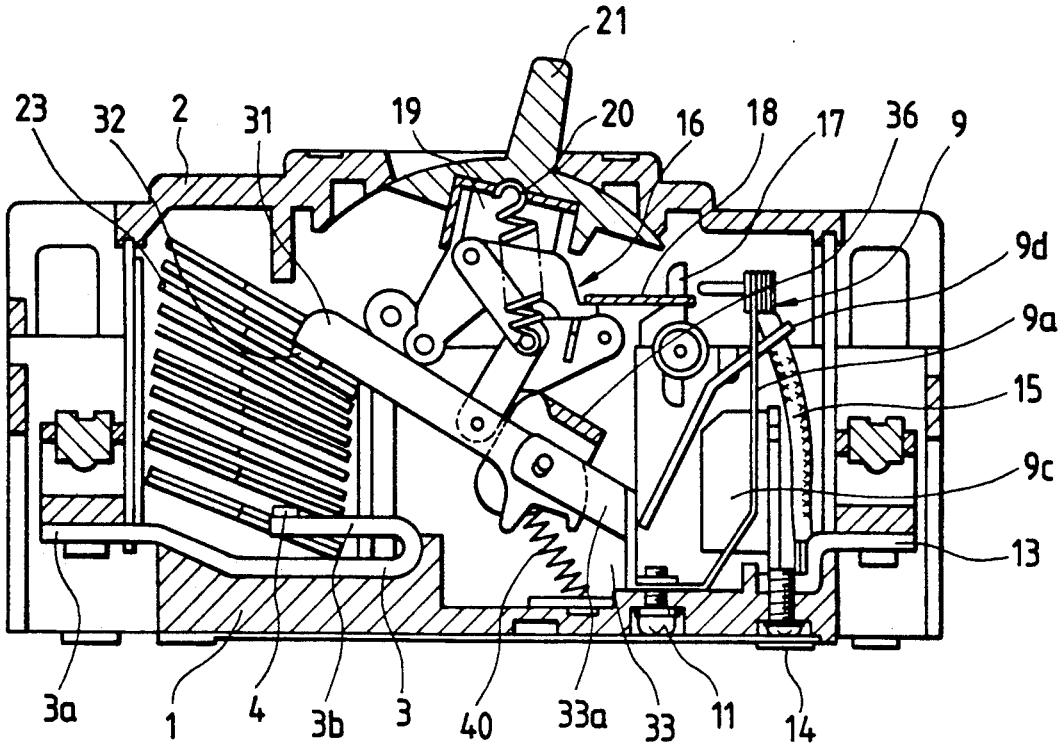
FIG. 4 is a vertical sectional view showing the central pole which is open.

FIGS. 3 and 4 are sectional diagrams showing the circuit breaker having the movable contactor 31 and the connecting conductor 33 shown in FIG. 1. In FIG. 3, the circuit breaker is closed, and in FIG. 4, it is open. In the circuit breaker, the current flowing from the stationary contactor 3 through the stationary contact 4, the movable contact 8 to the movable contactor 31 is allowed to flow directly to the connecting conductor 33 because the side walls of the movable contactor 31 are in slide contact with the inner walls of the arms 33*a*, and then the current flows through the bimetallic member 9*a* and the flexible conductor 15 to the terminal 13. A contact spring 40 composed of a compression spring inserted between the case 1 and the movable contactor 31 is formed so as to urge the movable contactor 31 towards the stationary conductor 3. Thereby, a suitable contact pressure is applied to the movable contactor 31. The other construction and operation are the same as those in the conventional circuit breaker described above.

FIGS. 5 through 9 show a third embodiment of the invention, which is more praCtical than the first and second embodiments described above.

Figure 5A:
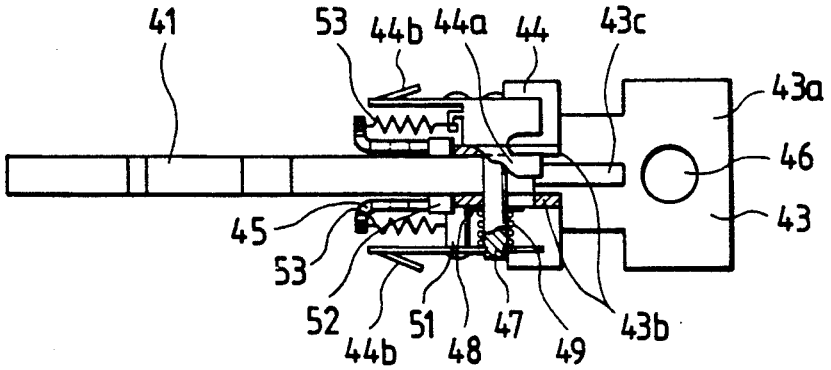
FIG. 5A, FIG. 5B and FIG. 5C are a plan view, a side view and a rear view, respectively, showing a movable contactor and its relevant components in a third embodiment of the invention.
Figure 5B:
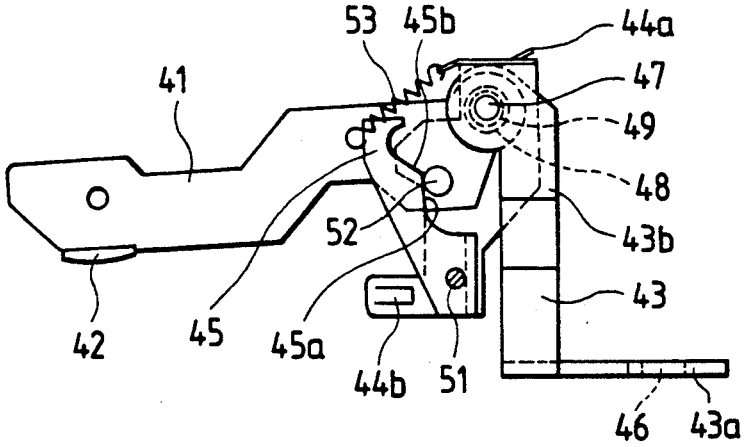
Figure 5C:
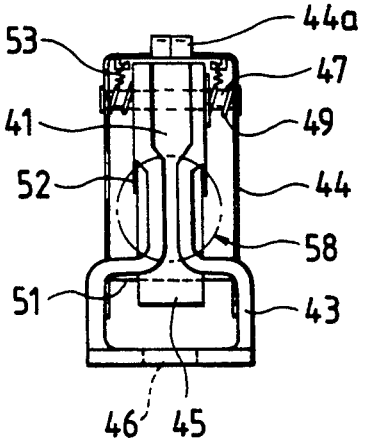

FIG. 5 shows a movable contactor and a connecting conductor kept in slide contact with it. More specifically, FIG. 5A, FIG. 5B and FIG. 5C are a plan view in which an upper portion of a copper plate 44 (which will be described later) is partially omitted, side view in which a side plate of the copper plate is partially omitted at the front side, and rear view, respectively, showing those components. In FIG. 5, reference character 41 designates the movable contactor formed by blanking a copper plate; 42, a movable contact welded to the end of the movable contactor 41 by brazing; 43, the connecting conductor formed by bending a copper plate; 44, a U-shaped mounting member formed by bending a thin elastic steel plate; and 45, a pawl made of steel plate, the pawl 45 forming a current limit mechanism.

The connecting conductor 43 has a base 43*a* with a through-hole 46 which is secured to the circuit breaker casing 1 with a screw inserted into the through-hole 46 formed, and a pair of arms 43*b* which are extended upwardly from the base 43*a* in such a manner as to confront with each other. The arms 43*b* are bent as shown in FIG. 5 to the extent that the distance therebetween is slightly smaller than the thickness of the movable contactor 41, so that they elastically hold the rear end portion of the movable contactor 41 which is forcibly inserted therebetween; that is, they are held in slide contact with the side walls of the movable contactor 41. In addition, as shown in FIG. 5A, the base portion 43*a* is formed with a slit 43*c* which is cut from a left end of the FIG. 5A to an adjacent portion of the through-hole 46 along a center line thereof in such a manner that the arms 43*b* are easily deformed in a lateral direction.

The movable contactor 41 and the arms 43*b* have through-holes in alignment with one another, into which a shaft 47 is relatively loosely inserted. Springs 49 and 49, composed of compression springs, are mounted on the shaft 47 through washers 48 and 48 on both sides of the arms 43*b*, respectively. Then, the two ends of the shaft 47 are coupled to the side walls of the mounting member 44 by caulking for instance. Thus, the movable contactor 41 is swingable about the shaft 47, and the arms 43*b* are suitably pushed against the movable contactor 41.

Figure 9A:
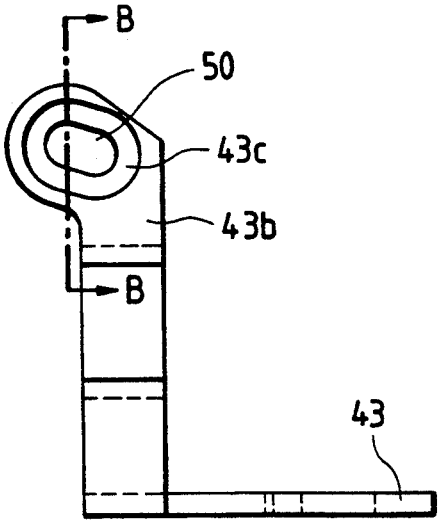
FIG. 9A is an enlarged side view showing a connecting conductor in FIG. 5.
Figure 9B:
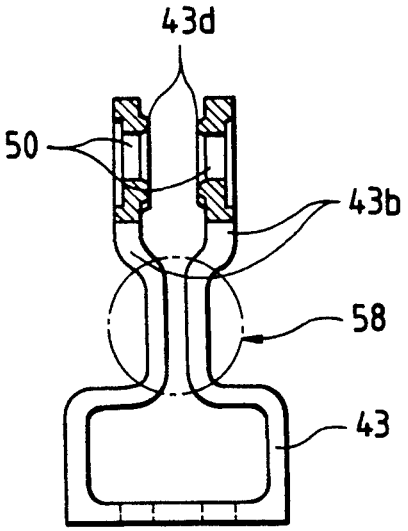
FIG. 9B is a sectional view taken along line B—B in FIG. 9A.

FIG. 9A is a side view of the connecting conductor 43, and FIG. 9B is a sectional view taken along line B—B in FIG. 9A. As shown in FIG. 9, annular protrusions 43*d* are formed around the through-holes 50 into which the shaft 47 is inserted, so that the annular protrusions are in contact with the movable contactor 41; that is, the contact area of the movable contactor 41 with the arms 43*b* is limited to the small annular protrusions. Accordingly, the brake torque applied to the movable contactor 41 by the frictional force is small, and the contact pressure is improved. In addition, even in the case where the switching operation is repeatedly carried out, the movable contact and the arms are held stably in contact with each other, because the contact area is stable.

Referring back to FIG. 5, the pawl 45 is rotatably supported by the mounting member 44 through a shaft 51, the two ends of which are secured to the side walls of the mounting member similarly as in the case of the above-described shaft 47. The pawl 45 is a fork-shaped hard component which is bent in the form of the character "U" near the shaft 51. The pawl 45 has a step 45*a* so as to engage with a pin 52 which is embedded in the movable contactor 41 in such a manner as to extend on both sides of the movable contactor 41. A pair of tension springs 53 are connected between the upper end portion of the pawl and the upper end portion of the mounting member so as to push the pawl against the pin 52 at all times. On the other hand, the movable contactor 41 is urged by the spring 53 through the pin 52 to turn about the shaft 47 in a counter-clockwise direction in FIG. 5B in such a manner that a rotation moment (torque) is applied to the movable contactor 41. When the circuit breaker is assembled (which will be described later), the movable contactor 41 is urged toward the stationary contactor 3 by the rotation moment (torque). That is, the spring 53 has functions of a contact spring.

The mounting member 44 has engaging pieces 44*a* and 44*b* which are formed by cutting its top plate and side plates, respectively. The assembly of the movable contactor 41 and the connecting conductor 43 is secured to the holder with the engaging pieces 44*a* and 44*b*. The holder will be described in more detail.

Figure 6:
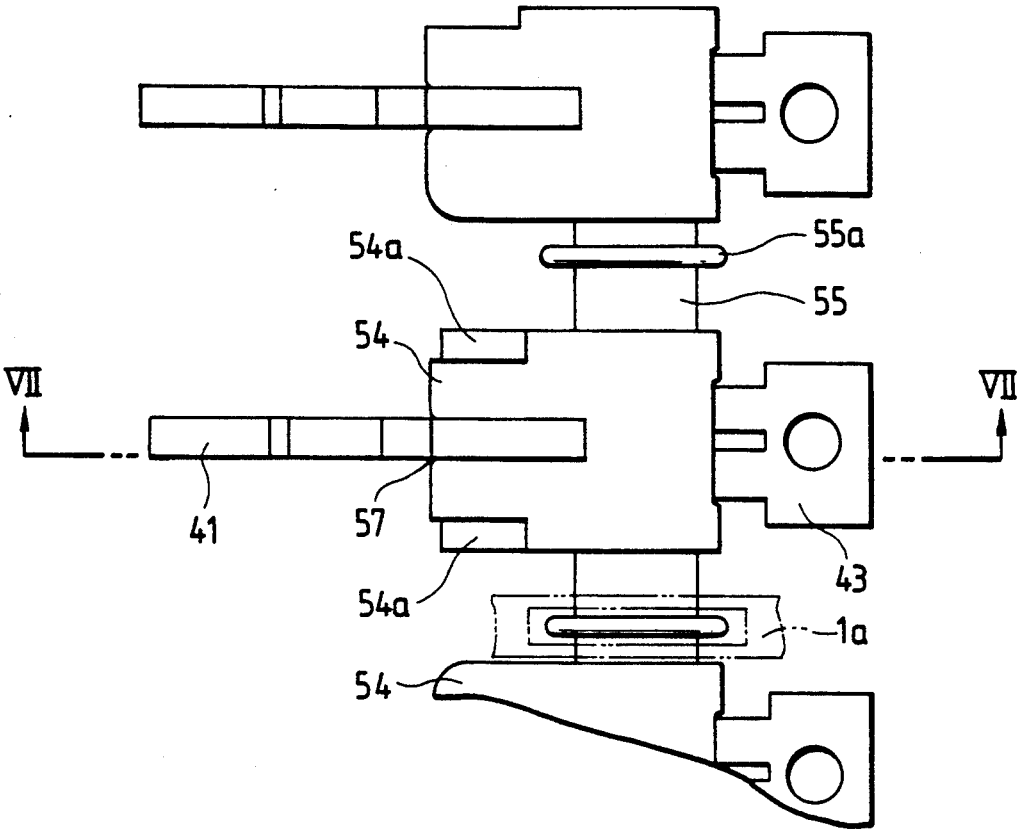
FIG. 6 is a plan view showing essential components of a holder holding the movable contactor shown in FIG. 5.
Figure 7:
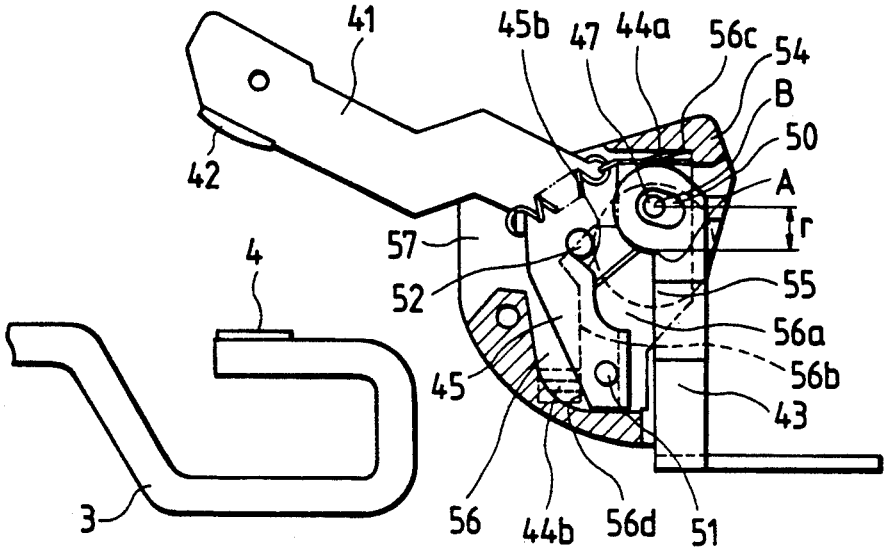
FIG. 7 is a sectional view taken along line VII—VII in FIG. 6.

FIG. 6 is a plan view showing the holder of the central pole, and FIG. 7 is a sectional view taken along line VII—VII in FIG. 7. As shown in FIG. 6, the holders 54 of the three poles are connected to one another through the switching shaft 55. Inter-phase barriers 55*a* are formed integral with the switching shaft 55. The holders 54 are rotatably supported with the coupling shaft 55 which is fitted in the bearing grooves of the inter-phase partition walls 1*a* (indicated by the two-dot chain line) of the casing 1. Notches 54*a* are formed at both side walls of the holder 54 of the central pole to connect links of an open-close structure.

The assembly shown in FIG. 5 is mounted to the holder 54 as indicated in FIG. 7. A recess 56 is formed in the holder 54 so as to permit the insertion of the assembly into the holder from behind, and a window 57 is formed in the front wall of the holder. The movable contactor 41 is inserted into the window 57 in such a manner that it is swingable for a switching operation. Fitting surfaces 56*a* are formed in the right and left walls of the recess 56 in correspondence to the width of the mounting member 44. The front edges 56*b* of the fitting surfaces 56*a* are made similar to the contour of the front wall of the mounting member 44. A step 56*c* is formed in the top wall of the recess 56 in correspondence to the engaging pieces 44*a*. In addition, steps 56*d* are formed in the right and left walls of the recess in such a manner that they are extended along the lower part of the front edge 56*b* of the fitting surface.

Figure 8:
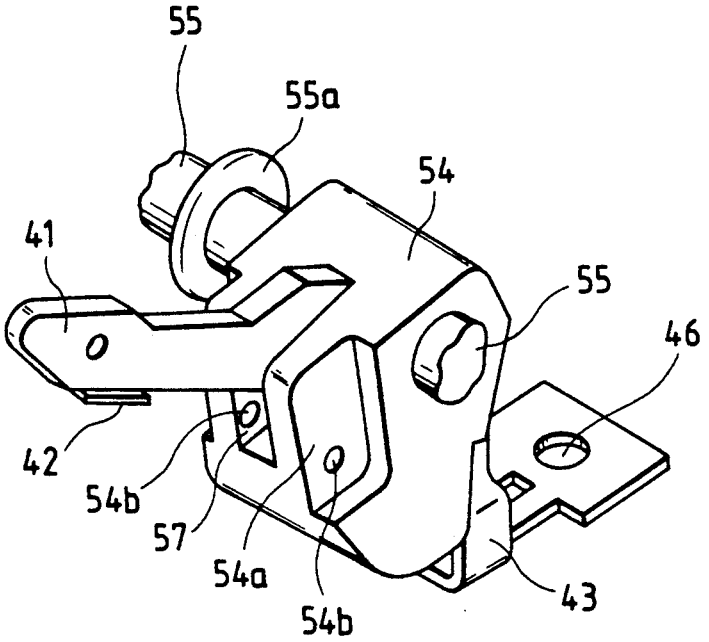
FIG. 8 is a perspective view showing the assembly of the holder in FIG. 6 and the movable contactor in FIG. 5.

The assembly shown in FIG. 5 is pushed into the holder with the engaging pieces 44*a* and 44*b* of the mounting member 44 elastically deformed inwardly until the front wall of the mounting member 44 abuts against the fitting surface front edges 56*b* of the right and left walls. In this operation, the engaging pieces 44*a* and 44*b*, being restored by the elastic forces thereof, are engaged with the steps 56*c* and 56*d*, respectively, thus being fixed as indicated in FIG. 7. FIG. 8 is a perspective view showing the holder 54 with the movable contactor 41 fixed in the above-described manner. However, through holes 54*b* are provided to insert pins for connecting links of the open-close structure.

Figure 12:
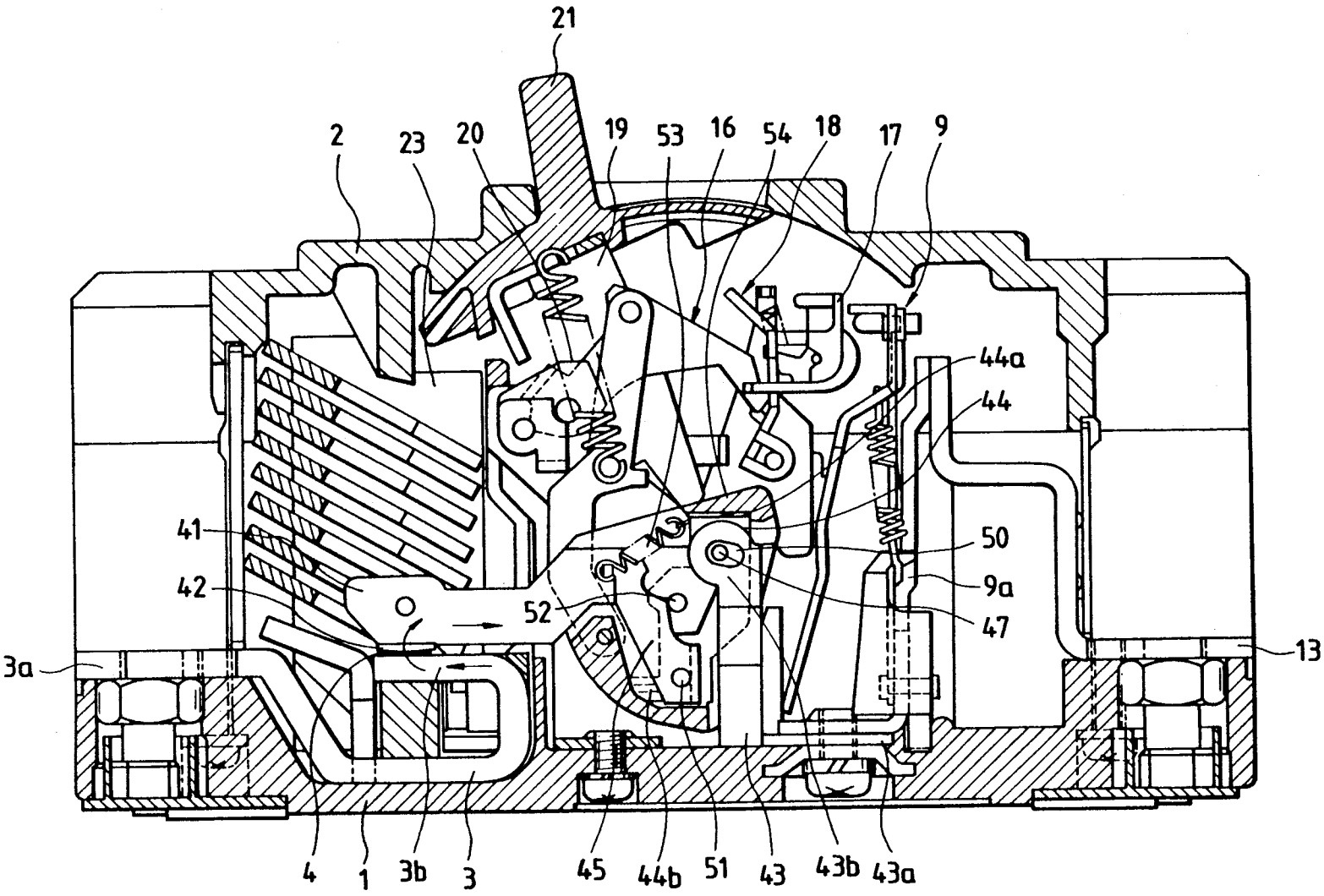
FIG. 12 is a sectional view showing a central pole of a circuit breaker having a movable contactor in FIG. 5 in which the pole is closed.

FIG. 12 is a vertical sectional view showing the central pole of the circuit breaker, which is closed, in which the holder 54 holding the assembly in FIG. 5 is assembled. The base 43 a of the connecting conductor 43 and the bimetallic member 9*a* are overlapped and secured to the case 1. Under a condition as shown in FIG. 12, the connecting conductor 41 is pressure-pushed toward the stationary contactor 3, so that the connecting conductor 41 is slightly rotated to turn about the shaft 47 in a clockwise direction. In response to this movement, the pawl 45 is rotated through the pin 52 against the spring 53 so as to turn about the shaft 51. As a result, a contact pressure between the contacts 4 and 42 is obtained due to the fact that the movable contactor 41 is subjected to a rotation moment (torque) from the spring 53 in the counter-clockwise direction in the FIG. 12.

The holder 54 and the movable contactor 41 built in the circuit breaker are rotatable about the central axis A (FIG. 7) of the coupling shaft 55; however, the central axis B of the shaft 47 is shifted a distance r from the central axis A of the coupling shaft 55, and therefore the shaft 47 is turned about the axis A with the radius r. In order to allow the shaft 47 to turn in this manner, the through-holes 50, into which the shaft 47 is inserted, are elongated as shown in FIG. 9A. As described above, the central axis B of the shaft 47 is shifted a distance r from the central axis A of the coupling shaft 55, so that the movable contactor 41 is slightly moved forward and backward (left and right direction in FIG. 12). Accordingly, the contacts 4 and 42 are slidably moved so as to eliminate an oxidation of the contact surfaces thereof.

A current limit interruption by the action of the pawl 45 will be described in brief. As shown in FIG. 12, the stationary contactor 3 includes a conductor portion 3*b* which is in parallel with the conductor of the movable contactor 5. When current flows in the conductor portion 3*b* and the movable contactor 41 through the contacts 4 and 42, the current in the conductor portion 3*b* and that in the movable contactor 41 are different in direction, thus inducing an electromotive repulsive force therebetween. As a result, the movable contactor 41 is continuously urged to move away from the stationary contactor.

When large current such as short-circuit current flows in the circuit breaker with the movable contactor 41 shown in FIG. 5B, the movable contactor 41 is greatly driven, so that it, going over the pawl 45 against the elastic force of the springs 53, is swung clockwise about the shaft 47, thus causing the pin 52 to ride on the wall 45*b* (FIG. 7) of the pawl 45. As a result, the elastic force of the springs 53 acts to quickly move the movable contactor away from the stationary contactor before it is done by the switching operation. Accordingly, the arc voltage is abruptly increased, so that the so-called "current limit interruption" is carried out. FIG. 7 indicates the result of the current limit interruption which had been done.

Figure 10A:
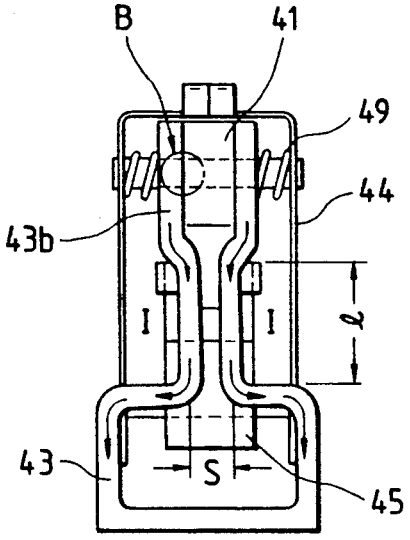
FIG. 10A is a rear view showing the movable contactor and the connecting conductor illustrated in FIG. 5C.
Figure 10B:
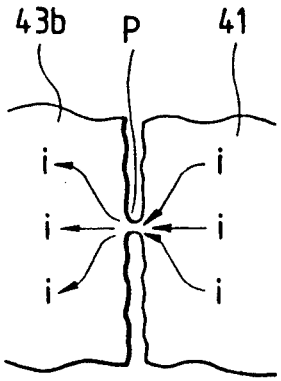
FIG. 10B is an enlarged diagram showing a portion B of FIG. 10A.

On the other hand, in the case where, as shown in FIG. 10A, the movable contactor 41 is in slide contact with the connecting conductor 43, current will flow through several contact points P in the contact area as shown in FIG. 10B which is an enlarged view showing the B-portion of FIG. 10A. As indicated by the arrows (i) in FIG. 10B, the current converges to pass through the contact point P, and after passing through the contact point P, it diverges. That is, the current flowing before passing through the contact point P is different in direction from that flowing after passing through the contact point P. Therefore, an electromagnetic repulsive force acts between the movable contactor 41 and the arms 43*b* of the connecting conductor 43.

The magnitude $F_1$ of the electromagnetic repulsive force is as follows:

$$F_1 = \Sigma 5 I_j^2 \times 10^{-2} \text{ (kg) (j=1 through n)}$$

where $I_k$(kA) is the current passing through a contact point P, and n is the number of contact points P. The electromagnetic repulsive force $F_1$ is abruptly increased as the current passing through the circuit breaker increases and accordingly the current passing through each contact point P increased. As a result, the elastic force of the springs 49 is reduced, so that the number of contact points P is decreased accordingly, whereby the current passing through the remaining contact points P becomes excessively large. Thus, arcing or welding may occur at the remaining contact points.

Accordingly, in the case where the movable contactor 41 is in slide contact with the connecting conductor 43, the applicable short-circuit current rating is limited to a certain value. The limit value may be increased by increasing the elastic force of the springs 49. However, this method will suffer from a difficulty that the movable contactor 41 is normally moved at low speed due to the fact that a friction force is increased. This difficulty may be eliminated by the following method: As shown in FIG. 5C and FIG. 9B, the arms 43*b* have portions 58 near the contact portions of the arms 43 with the movable contactor 41, which are so designed that the distance between the portions 58 is smaller than the distance between the contact portions. The action of the portions 58 will be described with reference to FIG. 10A.

It is assumed that the portion 58 of the arms have a length of 1, and are spaced by S from each other, and a current of I(kA) flows in each of the arm 43*b*. The currents I flowing in the arms 43*b* are the same in direction. Therefore, the following electromagnetic attractive force $F_2$ is inducted between the arms 43*b*:

$$F_2 = 2.04\ kl/S.I^2 \text{ (where k is the constant)}$$

Figure 11:
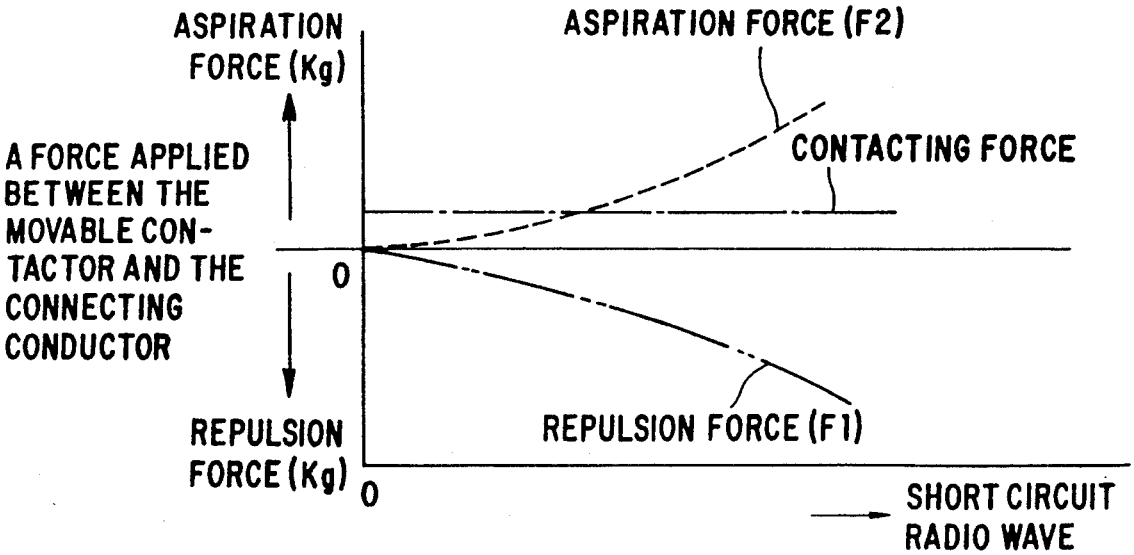
FIG. 11 is a graphical representation indication the variations of an electromagnetic repulsive force and an electromagnetic attractive force with a short-circuit current at a contact portion in FIG. 10.

If the distance S is so determined that the electromagnetic attractive force $F_2$ is larger than the above-described electromagnetic repulsive force $F_1$, then the applicable short-circuit current rating can be increased with the elastic force of the springs 49 maintained unchanged. FIG. 11 is a graphical representation indicating the variations of the electromagnetic repulsive force F and the electromagnetic attractive force $F_2$ with the short-circuit current passing through the circuit breaker. In addition, a contact force shown in FIG. 10A is directed to a force obtained by an elasticity of the spring 49 and the connecting conductor 43.

As shown in FIG. 9B, the annular protrusions 43*c* formed at the contact portions of the arms 43*b* serve as spacers to space the arms 43 from the movable contactor 41, thus increasing the distance between the currents flowing in the opposite directions before and after the contact region. As a result, the electromagnetic repulsive force $F_1$ is further decreased.

It is desirable that at least one of the slide contact surface of the movable contactor and the connecting conductor is plated with a compound of silver (Ag) and carbon (C), to prevent the difficulty that the contact surfaces are galled or welded when the circuit breaker is operated repeatedly under no load or when large current interruption is carried out, and to improve the electrical performance of the circuit breaker.

Experimental examples of the circuit breaker were manufactured in which the movable contactor 41 and the connecting conductor 43 as shown in FIG. 5 were plated as described above. The circuit breakers were manufactured and tested as follows:

Experimental Example 1—A film of Ag - 6% C (% by volume) was formed on the movable contactor 41 and the connecting conductor 43 to a thickness of 7 pm by electroplating. In this case, the carbon particles dispersed in the silver particles were 0.5 to 2 μm in major diameter and 0.2 to 0.5 μm.

Experimental Example 2—Similarly, a film of Ag - 3% C (% by volume) was formed on the movable contactor 41 and the connecting conductor 43 to a thickness of 7 pm by electroplating. In this case, the carbon particles dispersed in the silver particles were 0.8 to 5 μm in major diameter and 0.3 to 1 μm.

As for a comparison example, a film of Ag was formed on the movable contactor and the connecting conductor to a thickness of 7 μm by electroplating.

Those movable contactors and connecting conductors were used to form circuit breakers. And a no-load switching test and a large current interruption test were given to the circuit breakers thus provided, the results of which are as indicated in the following Table 1:

TABLE 1

| | Surface film | No-load switching test | Large current interruption test |
|---|---|---|---|
| Experimental example | Ag-6% C | No copper was exposed when a switching operation was performed 10,000 times | No copper was exposed with interruption of of 30 KA |
| Experimental example | Ag-3% C | No copper was exposed when a switching operation was performed 10,000 times | No copper was exposed with interruption of of 30 KA |
| Comparison example | Ag | Copper was exposed when a switching operation was performed 2,000 times | Copper was exposed with interruption of of 20 KA |

As is apparent from Table 1, in the case of the circuit breaker with the movable contactor and the connecting conductor plated with Ag - C compound material, when compared with the circuit breaker with those plated ordinarily, the copper is hardly exposed. Although the two experimental examples have been described, the percentage (%) and the grain size of C (carbon) are not limited to those indicated above because the effect of the invention depends on the properties of carbon. The damaging or welding of the slide contact portion depends on the area thereof and the surface pressure applied thereto. Hence, the area and the surface pressure should also be taken into account to determine the percentage by volume and the grain size of carbon. However, it is not preferable to increase the percentage by volume and the grain size of carbon (C) to excessively large values, because although being electrically conductive, carbon (C) is several hundred or several thousand times as high in resistance as silver (Ag); that is, the relatively high resistance accelerates the generation of heat at the slide contact portion, thereby to increase the terminal temperature of the circuit breaker.

In the above-described experimental examples, the electroplating method was employed. However, the movable contactor and the connecting conductor may be plated by other methods, because what is important is that they are plated with Ag - C compound material.

The slide contact portion is prevented from being galled or welded by the layer of carbon formed on it. Therefore, substantially the same effect can be obtained by forming the Ag - C film on one of the movable contactor and connecting conductor. In this case, the other should be plated with silver (Ag); however, since carbon has an oxidation preventing effect, the silver plating may not be necessary; that is, it is satisfactory in electrical characteristic to some extent as it is. It is not always necessary to cover the movable contactor and the connecting conductor in their entirety with the film; that is, all that is necessary is to cover the slide surfaces with the film.

Furthermore, it is recommended to disperse the following hard particles as third particles in the Ag-C compound material, to increase the hardness of the film thereby to provide the slide contact portions which are hardly worn and long in service life accordingly: SiC, WC, ZrB,. $Al_2O_3$, $ZrO_2$, $Cr_2O_3$, $TiO_2$, $R_2O_3$, $ThO_2$, $Y_2O_3$, $MoO_3$, $W_2C$, TiC, $B_4C$ and $CrB_2$.

As was described above, the movable contactor can be electrically connected to the connecting conductor without use of a flexible conductor according to the invention. Therefore, the circuit breaker high in reliability and excellent in interruption characteristic can be made smaller in size according to the invention. And the circuit breaker is made long in service life by plating the slide contact surfaces of the movable contactor and the connecting conductor with the silver and carbon compound material according to the invention.

While there has been described in connection with the preferred embodiments of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A circuit breaker comprising:

a frame;

a connecting conductor mounted on said frame;

a movable contactor slidably engaging said connecting conductor to create an electrical connection therebetween;

a shaft member projecting through through-holes in the connecting conductor and the movable contactor to rotatably connect said connecting conductor to said movable contactor;

a switching shaft rotatably supported by said frame;

a holder, formed of electrically insulating material, engaging each end of said shaft member and being rotatably supported by said switching shaft;

means for rotating said movable contactor relative to said connecting conductor in response to a predetermined current.

2. The circuit breaker of claim 1, wherein portions of said connecting conductor which contact said movable contactor are plated with a material containing silver and carbon.

3. The circuit breaker of claim 1, wherein portions of said movable contactor which contact said connecting conductor are plated with a material containing silver and carbon.

4. The circuit breaker of claim 1, wherein said connecting conductor includes a pair of arms, positioned on opposing sides of said movable contactor, having contacting portions which contact the movable contactor to electrically connect said connecting conductor to said movable contactor and means for urging said contacting portions against said movable contactor.

5. The circuit breaker of claim 4, wherein said urging means includes a spring.

6. The circuit breaker of claim 4, wherein said arms of said connecting conductor each have an inwardly curved portion, said inwardly curved portions confronting each other, a distance between the inwardly curved portions being smaller than a distance between the contacting portions.

7. A circuit breaker comprising:

a frame;

a connecting conductor mounted on said frame;

a movable contactor slidably engaging said connecting conductor to create an electrical connection therebetween;

a shaft member projecting through through-holes in the connecting conductor and the movable contactor to rotatably connect said connecting conductor to said movable contactor;

a mounting member having engaging projections, said mounting member being supported by said shaft member;

a switching shaft rotatably supported by said frame;

a holder, formed of electrically insulating material, having recesses which mate with said engaging projections to mount said holder on said mounting member and being rotatably supported by said switching shaft;

means for rotating said movable contactor relative to said connecting conductor in response to a predetermined current.

8. The circuit breaker of claim 7, wherein the shaft member and the switching shaft each have an axis of rotation, the axis of rotation of the shaft member being substantially parallel to the axis of rotation of the switching shaft and radially spaced therefrom.

9. The circuit breaker of claim 7, wherein said connecting conductor has annular protrusions around the through-holes for contacting the movable contactor.

10. The circuit breaker of claim 7, wherein portions of said connecting conductor which contact said movable contactor are plated with a material containing silver and carbon.

11. The circuit breaker of claim 7, wherein portions of said movable contactor which contact said connecting conductor are plated with a material containing silver and carbon.

12. The circuit breaker of claim 7, wherein said connecting conductor includes a pair of arms, positioned on opposing sides of said movable contactor, having contacting portions which contact the movable contactor to electrically connect said connecting conductor to said movable contactor and means for urging said contacting portions against said movable contactor.

13. The circuit breaker of claim 7, wherein said urging means includes a spring.

14. The circuit breaker of claim 7, wherein said arms of said connecting conductor each have an inwardly curved portion, said inwardly curved portions confronting each other, a distance between the inwardly curved portions being smaller than a distance between the contacting portions.

15. A circuit breaker comprising:

a frame;

a movable contactor;

a holder, formed of electrically insulating material, for holding said movable contactor;

a shaft member for rotatably supporting said holder;

a switching mechanism for driving said movable contactor about said shaft member together with said holder to perform a switching operation.

a connecting conductor mounted on said frame, said connecting conductor including a pair of arms positioned on opposing sides of said movable contactor, said arms having contacting portions which slidably engage the movable contactor to electrically connect said connecting conductor to said movable contactor and each of said arms having an inwardly curved portion, said inwardly curved portions confronting each other, a distance between the inwardly curved portions being smaller than a distance between the contacting portions such that an electromagnetic attractive force generated at the inwardly curved portions is greater than an electromagnetic repulsive force generated at the contacting portions; and means for urging said contacting portions against said movable contactor.

16. The circuit breaker of claim 15, wherein portions of said connecting conductor which contact said movable contactor are plated with a material containing silver and carbon.

17. The circuit breaker of claim 15, wherein portions of said movable contactor which contact said connecting conductor are plated with a material containing silver and a carbon.

* * * * *